US012690691B2

(12) United States Patent
Leng

(10) Patent No.: US 12,690,691 B2
(45) Date of Patent: Jul. 28, 2026

(54) ELASTIC MODULE, ELASTIC MATTRESS AND FURNITURE

(71) Applicant: NEW-TEC INTEGRATION (XIAMEN) CO., LTD., Fujian (CN)

(72) Inventor: Luhao Leng, Xiamen (CN)

( * ) Notice: Subject to any disclaimer, the term of this patent is extended or adjusted under 35 U.S.C. 154(b) by 135 days.

(21) Appl. No.: 18/687,755

(22) PCT Filed: Aug. 4, 2022

(86) PCT No.: PCT/CN2022/110196

§ 371 (c)(1),
(2) Date: Feb. 28, 2024

(87) PCT Pub. No.: WO2023/029873

PCT Pub. Date: Mar. 9, 2023

(65) Prior Publication Data

US 2024/0423383 A1 Dec. 26, 2024

(30) Foreign Application Priority Data

Aug. 31, 2021 (CN) ..... 202111013334.9

(51) Int. Cl.
*A47C 27/06* (2006.01)

(52) U.S. Cl.
CPC ..... *A47C 27/064* (2013.01)

(58) Field of Classification Search
CPC ..... A47C 23/05; A47C 27/06; A47C 27/063; A47C 27/065; A47C 27/064
See application file for complete search history.

(56) References Cited

U.S. PATENT DOCUMENTS 2,077,497 A * 4/1937 Stevens ..... A47C 27/07 24/103
4,423,308 A 12/1983 Callaway et al.
5,332,202 A * 7/1994 Wagner ..... A47C 23/0438 5/255
5,548,857 A * 8/1996 Richmond ..... A47C 23/05 5/259.1

(Continued)

FOREIGN PATENT DOCUMENTS

CN 101123900 A 2/2008
CN 105747679 A 7/2016

(Continued)

OTHER PUBLICATIONS

English translation of International Search Report of International Application No. PCT/CN2022/110196; Date of Mailing: Sep. 28, 2022; 2 pages.

(Continued)

*Primary Examiner* — Matthew Troutman
*Assistant Examiner* — Ifeolu A Adeboyejo
(74) *Attorney, Agent, or Firm* — Perkins Coie LLP

(57) ABSTRACT

An elastic module assembly is used to form an elastic pad. The elastic module assembly includes a middle support layer having upper elastic modules connected among adjacent upper strip-shaped mounting frames on an upper surface of the middle support layer. Lower elastic modules are connected among adjacent lower strip-shaped mounting frames on a lower surface of the middle support layer. The elastic module assembly is simple in construction and provides enhanced comfort.

16 Claims, 4 Drawing Sheets

(56) References Cited

U.S. PATENT DOCUMENTS

| | | | | |
|---|---|---|---|---|
| 5,752,284 | A * | 5/1998 | Dabney | A47C 23/05 5/247 |
| 7,850,153 | B2 | 12/2010 | Bock | |
| 8,370,979 | B2 | 2/2013 | Fukano | |
| 2008/0184492 | A1 | 8/2008 | Sunde | |
| 2009/0014929 | A1* | 1/2009 | Bock | A47C 27/065 267/179 |
| 2013/0228959 | A1* | 9/2013 | Bock | A47C 23/002 403/291 |
| 2014/0215722 | A1* | 8/2014 | Lobry | A47C 23/04 267/142 |
| 2017/0340129 | A1* | 11/2017 | Leng | A47C 23/005 |
| 2018/0199728 | A1* | 7/2018 | Leng | A47C 27/05 |
| 2023/0200553 | A1* | 6/2023 | Leng | A47C 23/002 5/720 |

FOREIGN PATENT DOCUMENTS

| | | | |
|---|---|---|---|
| CN | 107157191 | A | 9/2017 |
| CN | 206534409 | U | 10/2017 |
| CN | 109730488 | A | 5/2019 |
| CN | 110897422 | A | 3/2020 |
| CN | 212698303 | U | 3/2021 |
| CN | 112674535 | A | 4/2021 |
| CN | 112674536 | A | 4/2021 |
| GB | 2203938 | A | 11/1988 |
| JP | 2003204844 | A | 7/2003 |
| JP | 2010252937 | A | 11/2010 |
| JP | 2017196326 | A | 11/2017 |
| KR | 20090003442 | U | 1/2009 |
| WO | 2005084495 | A1 | 9/2005 |

OTHER PUBLICATIONS

Extended European Search Report for European Application No. 22863014.1; Date of Mailing: Jul. 15, 2025; 5 pages.

* cited by examiner

ELASTIC MODULE, ELASTIC MATTRESS AND FURNITURE

TECHNICAL FIELD

The present disclosure relates to the field of furniture, and particularly to an elastic module assembly, an elastic pad and a furniture comprising the same.

BACKGROUND

Furniture such as beds is an indispensable object in people's life. Most of the conventional large-sized furniture is not easily disassembled or not easily restored after disassembly. However, with the development of modern life, it is required furniture especially such as beds are able to be disassembled and assembled more and more frequently to meet the needs of population migration and field leisure. During transportation, it is very difficult to disassemble and assemble the beds, resulting in that the beds which are still in use are sometimes discarded to reduce the transportation burden.

A bed usually consists of a bed frame, an elastic pad and an outer covering. A conventional elastic pad is usually in a form of a one-piece, non-detachable, integral pad formed from a plurality of superimposed layers and springs. The integral pad is relatively larger in size and thus is not easy to be disassembled and stored, and the comfort thereof also needs to be improved. In addition, the integral pad further has a drawback of difficulty in cleaning.

SUMMARY

To address at least some of the above problems in the prior art, an object of the present disclosure is to provide an elastic module assembly for an elastic pad. The elastic module assembly is simple in construction and is capable of at least significantly enhancing the comfort of the elastic pad.

In order to achieve the above object, the present disclosure provides an elastic module assembly used to form an elastic pad, the elastic module assembly comprising a middle support layer having an upper surface and a lower surface arranged opposite to the upper surface, wherein a plurality of upper strip-shaped mounting frames are arranged on the upper surface and spaced from each other at an interval, and an upper elastic module mounting space is formed between adjacent upper strip-shaped mounting frames, so that the upper surface has a plurality of upper elastic module mounting spaces, and a plurality of upper elastic modules connected among adjacent upper strip-shaped mounting frames are disposed in each of the plurality of upper elastic module mounting spaces; and wherein a plurality of lower strip-shaped mounting frames are provided on the lower surface and spaced from each other at an interval, a lower elastic module mounting space is formed between adjacent lower strip-shaped mounting frames, so that the lower surface has a plurality of said lower elastic module mounting spaces, and a plurality of lower elastic modules connected among adjacent lower strip-shaped mounting frames are disposed in each of the plurality of lower elastic module mounting spaces.

In the said technical solution, the upper strip-shaped mounting frames and the lower strip-shaped mounting frames are respectively disposed on the upper surface and the lower surface of the same middle support layer, and the plurality of upper elastic modules are connected between adjacent upper strip-shaped mounting frames, and the plurality of lower elastic modules are connected between adjacent lower strip-shaped mounting frames. In this way, the upper elastic modules and the lower elastic modules can be stably and reliably supported by the respective corresponding strip-shaped mounting frames on the upper surface and the lower surface of the same middle support layer, so that the upper elastic modules and the lower elastic modules function as a double-layer elastic support. With excellent and stable support for the upper elastic modules and the lower elastic modules that is provided by the same middle support layer, the structure of the elastic module assembly can be simplified, and at least the comfort of the elastic pad is significantly improved.

According to one embodiment of the present disclosure, each said upper strip-shaped mounting frame and each corresponding lower strip-shaped mounting frame are oppositely arranged in a height direction of the elastic module assembly, and each said upper elastic module and each said lower elastic module are oppositely arranged in the height direction of the elastic module assembly.

According to one embodiment of the present disclosure, the each said upper strip-shaped mounting frame and each said lower strip-shaped mounting frame arranged opposite to each other and the middle support layer are connected via a connecting member passing through the upper strip-shaped mounting frame, the lower strip-shaped mounting frame and the middle support layer.

According to one embodiment of the present disclosure, the plurality of upper elastic modules and the plurality of lower elastic modules are detachable, and the middle support layer can be wound up, so that the middle support layer can be wound up and stored together with the upper strip-shaped mounting frame and the lower strip-shaped mounting frame.

According to one embodiment of the present disclosure, the upper elastic module and the lower elastic module are in a shape of truncated cone, wherein a larger-sized end of the upper elastic module is connected to the upper strip-shaped mounting frame, and a smaller-sized end of the upper elastic module faces upwards; and wherein a larger-sized end of the lower elastic module is connected to the lower strip-shaped mounting frame, and a smaller-sized end of the lower elastic module faces downward.

According to one embodiment of the present disclosure, each of the upper elastic modules and the lower elastic modules is formed with a frustum-shaped cavity and can be disassembled, so that the upper elastic modules and the lower elastic modules can be successively nested and stacked one on another.

According to one embodiment of the present disclosure, each of the upper elastic modules and the lower elastic modules comprises a spring support and a conical spring arranged in the spring support; the spring support comprises a base, a top cover and flexible strips connected between the base and the top cover; a larger-diameter end of the conical spring is connected to the base, a smaller-diameter end of the conical spring is connected to the top cover, an outer peripheral profile of the conical spring is in contact with the flexible strips, wherein the conical spring is in a pre-compressed state in the spring support.

According to one embodiment of the present disclosure, the plurality of upper elastic modules can be sequentially slid and snapped between adjacent upper strip-shaped mounting frames by a slide-and-snapping structure including an engagement groove and an engagement block, and the plurality of lower elastic modules can be sequentially slid and snapped between adjacent lower strip-shaped mounting frames by a slide-and-snapping structure including an engagement groove and an engagement block.

According to one embodiment of the present disclosure, both sides of the upper strip-shaped mounting frame are respectively formed with the engagement groove extending in a longitudinal direction of the strip-shaped mounting frame, both sides of each said upper elastic module are formed with the engagement block, so that the plurality of upper elastic modules can be connected between adjacent upper strip-shaped mounting frames by successively sliding their respective own engagement blocks into the engagement grooves from an entrance of the engagement grooves; both sides of the lower strip-shaped mounting frame are respectively formed with the engagement groove extending in the longitudinal direction of the strip-shaped mounting frame, both sides of each said lower elastic module are formed with the engagement block, so that the plurality of lower elastic modules can be connected between adjacent lower strip-shaped mounting frames by successively sliding their respective own engagement blocks into the engagement grooves from the entrance of the engagement grooves.

According to one embodiment of the present disclosure, the elastic module assembly comprises an upper balancing pad having a plurality of positioning holes and a lower balancing pad having a plurality of positioning holes, wherein the upper balancing pad is laid on the plurality of upper elastic modules such that a portion of each of said upper elastic modules are received into a corresponding positioning hole of the upper balancing pad to restrict the movement of each of said upper elastic modules in a transverse direction of the upper balancing pad; the lower balancing pad is laid under the plurality of lower elastic modules such that a portion of each of said lower elastic modules is received into a corresponding positioning hole of the lower balancing pad to restrict movement of each of said lower elastic modules in a transverse direction of the lower balancing pad.

According to one embodiment of the present disclosure, a peripheral edge of the middle support layer comprises a part of a detachable structure configured to connect with the other part of the detachable structure provided on a side enclosure covering portion of the outer covering, so that the peripheral edge of the middle support layer is configured to connect with the side enclosure covering portion via the detachable structure.

According to one embodiment of the present disclosure, the detachable structure comprises a zipper structure, wherein a part of the detachable structure is a toothed belt of the zipper structure.

In addition, the present disclosure provides an elastic pad, comprising an outer covering, an elastic pad layer, and the elastic module assembly described above, wherein the elastic pad layer and the elastic module assembly are superimposed in an up-down direction and covered by the outer covering. In this way, the comfort of the elastic pad can be at least effectively improved as described above.

According to one embodiment of the present disclosure, the elastic pad is a mattress.

Finally, the present disclosure provides a furniture comprising the elastic pad as described above. As described above, the comfort of the furniture can be significantly improved by the elastic pad, thereby improving the overall quality of the furniture.

In addition, the furniture includes, but is not limited to, beds, sofas, chairs, sofas beds, soft-packaged benches, and the like.

It is evident that elements or features described in a single embodiment above may be used alone or in combination in other embodiments.

BRIEF DESCRIPTION OF THE DRAWINGS

In the figures, sizes and proportions do not represent sizes and proportions of actual products. The figures are merely illustrative, and certain unnecessary elements or features have been omitted for the sake of clarity.

DESCRIPTION OF REFERENCE NUMERALS

1—elastic module assembly, 2—elastic pad, 3—middle support layer, 4—upper strip-shaped mounting frame, 5—upper elastic module, 6—lower strip-shaped mounting frame, 7—lower elastic module, 8—spring support, 9—conical spring, 10—base, 11—top cover, 12—flexible strip, 13—engagement groove, 14—engagement block, 15—upper balancing pad, 16—lower balancing pad, 17—outer covering, 18—elastic pad layer, 19—side enclosure covering portion.

DETAILED DESCRIPTION OF EMBODIMENTS

Hereunder, the present disclosure will be described in detail with reference to the accompanying drawings. What have been described herein are merely preferred embodiments according to the present disclosure. Those skilled in the art can conceive of other ways of implementing the present disclosure on the basis of the preferred embodiments, and said other ways also fall within the scope of the present disclosure.

Figure 1:
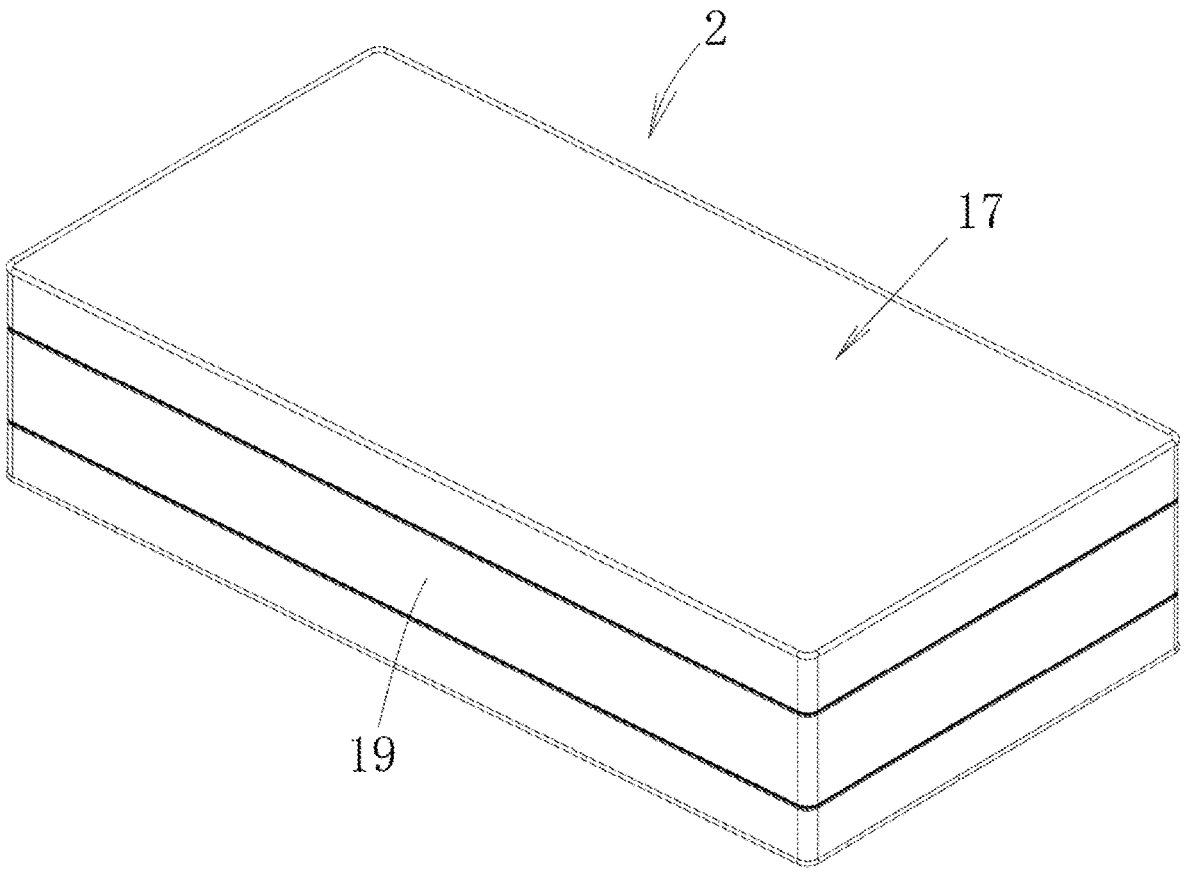
FIG. 1 schematically illustrates a perspective view of an elastic pad according to an embodiment of the present disclosure.
Figure 2:
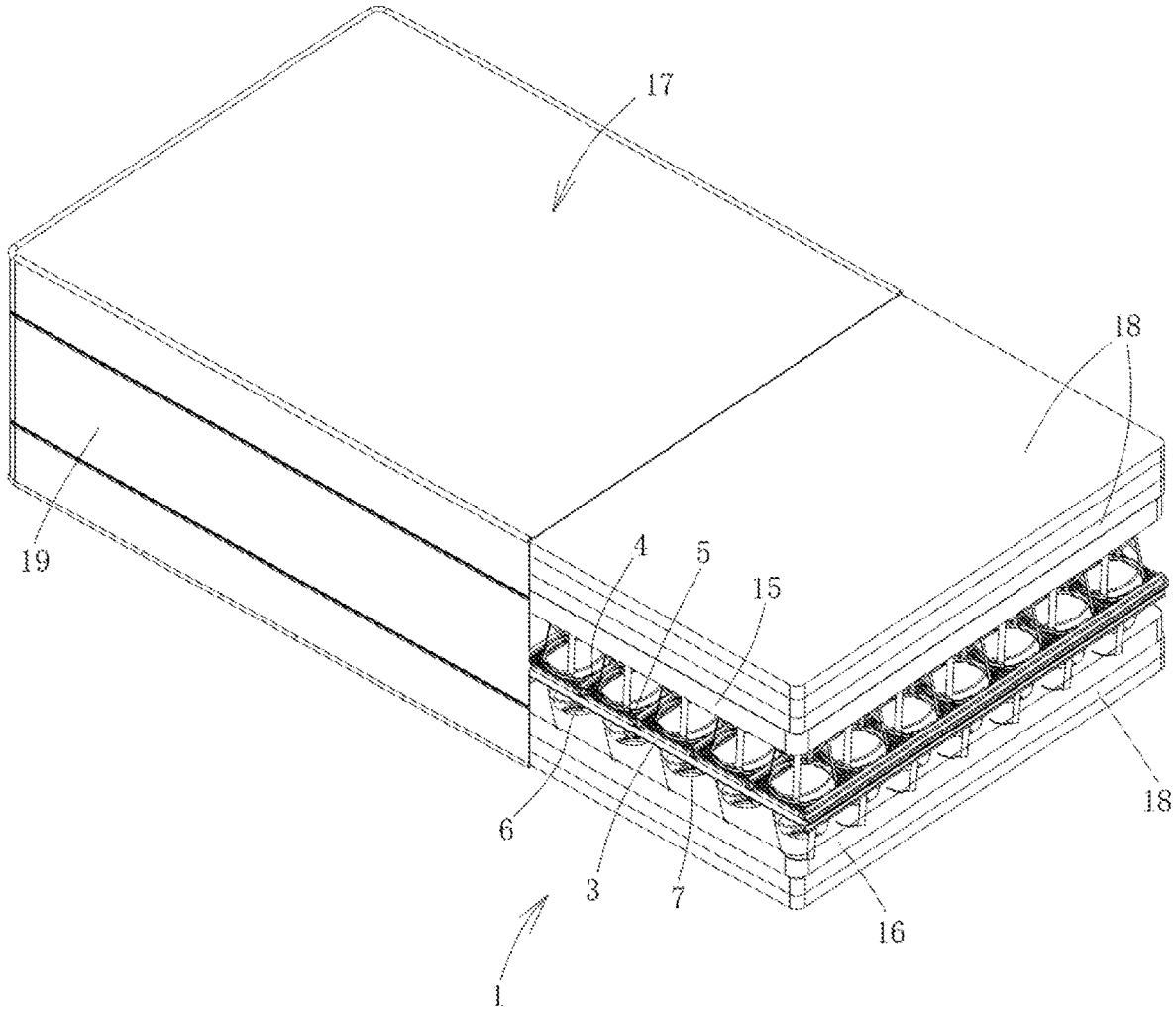
FIG. 2 is a schematic view of the elastic pad of FIG. 1 with a portion of an outer covering removed to show a pad body.
Figure 3:
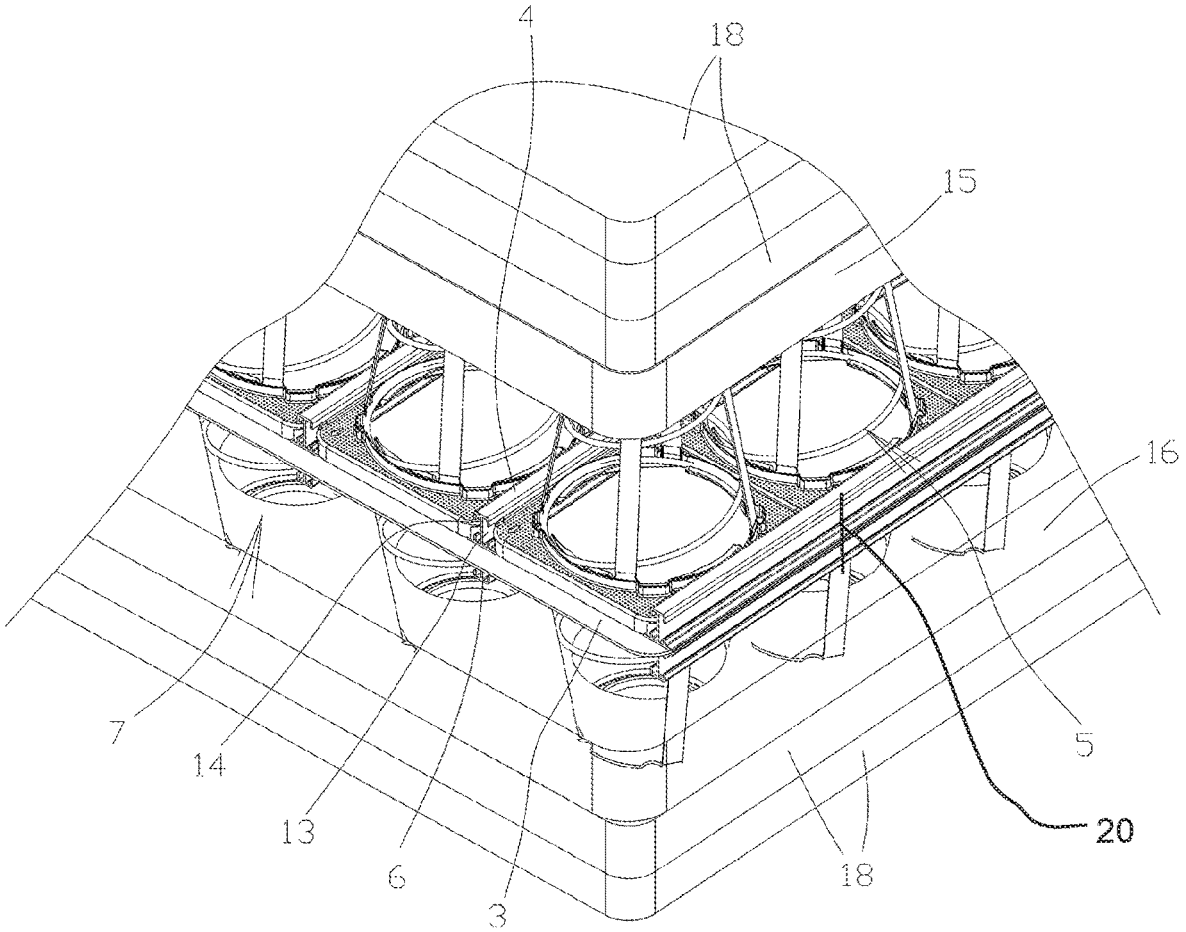
FIG. 3 is an enlarged view of a partial structure in FIG. 2.

With reference to FIG. 2 and FIG. 3, an elastic module assembly 1 provided by the present disclosure is used to form an elastic pad 2. The elastic module assembly 1 comprises a middle support layer 3, and the middle support layer 3 comprises an upper surface and a lower surface opposite to the upper surface, wherein a plurality of upper strip-shaped mounting frames 4 are arranged on the upper surface and spaced from each other at an interval, and an upper elastic module mounting space is formed between adjacent upper strip-shaped mounting frames 4, so that the upper surface has a plurality of upper elastic module mounting spaces, and a plurality of upper elastic modules 5 connected among adjacent upper strip-shaped mounting frames 4 are disposed in each of the plurality of upper elastic module mounting spaces; a plurality of lower strip-shaped mounting frames 6 are provided on the lower surface and spaced from each other at an interval, a lower elastic module mounting space is formed between adjacent lower strip-shaped mounting frames 6, so that the lower surface has a plurality of lower elastic module mounting spaces, and a plurality of lower elastic modules 7 connected among adjacent lower strip-shaped mounting frames 6 are disposed in each of the plurality of lower elastic module mounting spaces.

In said technical solution, the upper strip-shaped mounting frames 4 and the lower strip-shaped mounting frames 6 are respectively disposed on the upper surface and the lower surface of the same middle support layer 3, and the plurality of upper elastic modules 5 are connected between adjacent upper strip-shaped mounting frames 4, and the plurality of lower elastic modules 7 are connected between adjacent lower strip-shaped mounting frames 6. In this way, the upper elastic modules 5 and the lower elastic modules 7 can be stably and reliably supported by the respective corresponding strip-shaped mounting frames on the upper surface and the lower surface of the same middle support layer 3, so that the upper elastic modules 5 and the lower elastic modules 7 function as a double-layer elastic support. With excellent and stable support for the upper elastic modules 5 and the lower elastic modules 7 that is provided by the same middle support layer 3, the structure of the elastic module assembly can be simplified, and at least the comfort of the elastic pad is significantly improved.

The same middle support layer 3 may be a canvas layer or may be a quilted fabric layer.

In the elastic module assembly, the plurality of upper strip-shaped mounting frames 4 may be arranged at an interval in parallel in a first arrangement manner, and the plurality of lower strip-shaped mounting frames 6 may be arranged at an interval in parallel in a second arrangement manner different from the first arrangement manner, for example, the plurality of upper strip-shaped mounting frames 4 may be arranged transversely to form a plurality of rows, whereas the plurality of lower strip-shaped mounting frames 6 may be arranged longitudinally to form a plurality of columns. Alternatively, in an alternative embodiment, the plurality of upper strip-shaped mounting frames 4 and the plurality of lower strip-shaped mounting frames 6 are arranged in the same manner. Referring to FIG. 3, each upper strip-shaped mounting frame 4 and each corresponding lower strip-shaped mounting frame 6 are oppositely arranged in a height direction of the elastic module assembly, and each upper elastic module 5 and each lower elastic module 7 are oppositely arranged in the height direction of the elastic module assembly. In this way, each upper elastic module 5 can significantly absorb the pressure, and then each corresponding lower elastic module 7 below continues to absorb the pressure, thereby successively absorbing the pressure in the height direction of the elastic pad, and improving comfort.

In addition, in the elastic module assembly, each of the upper strip-shaped mounting frames 4 and each of the lower strip-shaped mounting frames 6 may be connected to the upper surface and the lower surface of the middle support layer 3, for example, by bonding or ultrasonic welding, etc. Alternatively, to improve the integrity of the connection between each upper strip-shaped mounting frame 4 and each corresponding lower strip-shaped mounting frame 6, each upper strip-shaped mounting frame 4 and each lower strip-shaped mounting frame 6 arranged opposite to each other and the middle support layer 3 are connected via a connecting member 20 passing through the upper strip-shaped mounting frame 4, the lower strip-shaped mounting frame 6 and the middle support layer 3. In this way, the same connecting member connects the upper strip-shaped mounting frame 4, the lower strip-shaped mounting frame 6 and the middle support layer 3 as a whole, thereby further improving the reliability and integrity of the support for the upper and lower elastic modules. In addition, the connecting member 20 may be a connecting screw, for example the connecting screw is screwed into the upper strip-shaped mounting frame 4 and through the middle support layer 3 and then screwed into the lower strip-shaped mounting frame 6. Alternatively, the connecting member may comprise a plugging post and a plugging hole, a connecting hole is formed on the middle support layer 3, the plugging post may be formed on one of the upper strip-shaped mounting frame 4 and the lower strip-shaped mounting frame 6, the plugging hole may be formed on the other of the upper strip-shaped mounting frame 4 and the lower strip-shaped mounting frame 6, and the plugging post may pass through the connecting hole of the middle support layer 3 and be inserted into the plugging hole, thereby connecting the upper strip-shaped mounting frame 4, the lower strip-shaped mounting frame 6 and the middle support layer 3 as a whole. If necessary, the plugging post can be hot melted, so that the plugging post is hot melted after passing through the connecting hole and then inserted into the plugging hole, thereby further improving the reliability of the engagement of the plugging post and plugging hole.

In addition, in an alternative embodiment, the plurality of upper elastic modules 5 and the plurality of lower elastic modules 7 are detachable, and the middle support layer 3 is a flexible layer and can be wound up, so that the middle support layer 3 can be wound up and stored or received together with the upper strip-shaped mounting frame 4 and the lower strip-shaped mounting frame 6. In this way, when the elastic module assembly needs to be detached, stored and transported, the plurality of upper elastic modules 5 and the plurality of lower elastic modules 7 may be detached, and then the middle support layer 3 may be wound, and the middle support layer 3 may be wound up together with the upper strip-shaped mounting frame 4 and the lower strip-shaped mounting frame 6 to be stored or received, and therefore, the elastic module assembly may be easily disassembled, storage and transportation space can be greatly saved, and cleaning may be easily performed.

Further, in an alternative embodiment, the upper elastic module 5 and the lower elastic module 7 may be equal-diameter cylinders, such as cylinders or square cylinders. Alternatively, as shown in FIG. 2 and FIG. 3, the upper elastic module 5 and the lower elastic module 7 are in a shape of truncated cone, wherein a larger-sized end of the upper elastic module 5 is connected to the upper strip-shaped mounting frame 4, and a smaller-sized end of the upper elastic module 5 faces upwards; a larger-sized end of the lower elastic module 7 is connected to the lower strip-shaped mounting frame 6, and a smaller-sized end of the lower elastic module 7 faces downward. For example, the smaller-sized end of the lower elastic module assembly 7 faces downward and may be positioned in a respective positioning hole of a lower balancing pad described below. In this way, the two larger-sized ends of the frustum-shaped elastic modules face each other to provide more stable and reliable support to the elastic modules, so that the smaller-sized ends can receive a force more stably, so that the elastic modules can be compressed more stably, thereby providing a more stable elastic performance.

In addition, in an alternative embodiment, the upper elastic module 5 and the lower elastic module 7 may be a solid body, or a mesh structure may be formed in the upper elastic module 5 and the lower elastic module 7, or each of the upper elastic modules 5 and the lower elastic modules 7 is formed with a frustum-shaped cavity and can be disassembled, so that the upper elastic modules 5 and the lower elastic modules 7 may be successively nestled and stacked one on another. In this way, when the elastic modules need to be received, stored and transported, the upper elastic modules 5 and the lower elastic modules 7 may be detached and then successively nestled and stacked together via the frustum cavities, thereby reducing the occupied space and facilitating storage and transport, and facilitating quick assembly of the elastic modules upon use.

Figure 4:
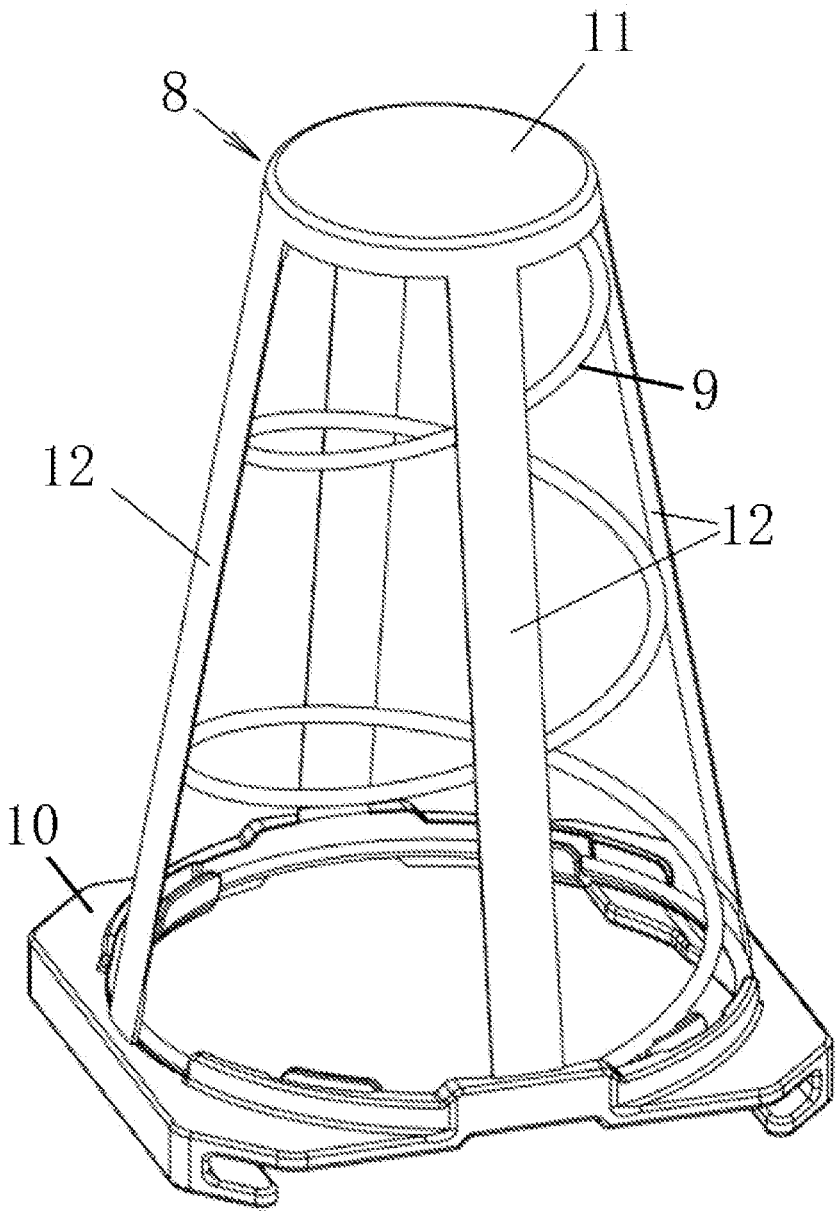
FIG. 4 schematically illustrates a schematic view of an elastic module of an elastic module assembly according to the present disclosure.

In addition, the upper elastic modules 5 and lower elastic modules 7 may have various types, for example, the upper elastic modules 5 and lower elastic modules 7 may be column-shaped elastic blocks such as rubber blocks, or may be cylindrical or cone-shaped rubber cylinders. Alternatively, referring to FIG. 4, each of the upper elastic modules 5 and the lower elastic modules 7 comprises a spring support 8 and a conical spring 9 arranged in the spring support 8; the spring support 8 comprises a base 10, a top cover 11 and flexible strips 12 connected between the base 10 and the top cover 11; a larger-diameter end of the conical spring 9 is connected to the base 10, a smaller-diameter end of the conical spring 9 is connected to the top cover 11, an outer peripheral profile of the conical spring 9 is in contact with the flexible strips 12, and the conical spring 9 is in a pre-compressed state in the spring support 8. The conical spring 9 in a compressed state can provide a more comfortable elastic support, and meanwhile make the flexible strips 12 in a tensioned state, so that the outer peripheral profile of the conical spring 9 can make a better contact with the flexible strips 12, thereby better limiting the conical spring 9 in the transverse direction.

In addition, in the elastic module assembly, the upper elastic modules 5 and the lower elastic modules 7 can be mounted on the respective strip-shaped mounting frames in various manners such as connection via screws or clamping via a clamping structure. Alternatively, in other alternative embodiments, referring to FIG. 2 and FIG. 3, the plurality of upper elastic modules 5 can be sequentially slid and clamped between adjacent upper strip-shaped mounting frames 4 by a slide-and-snapping structure including an engagement groove 13 and an engagement block 14, and the plurality of lower elastic modules 7 may be sequentially slid and clamped between adjacent lower strip-shaped mounting frames 6 by a slide-and-snapping structure including an engagement groove 13 and an engagement block 14. In this way, upon assembly, the plurality of upper elastic modules 5 may be conveniently assembled and connected between the adjacent upper strip-shaped mounting frames 4 by sliding each of the engagement blocks 14 into the engagement groove 13 in sequence from an entrance of one side or both sides of the engagement groove 13, and similarly, the plurality of lower elastic modules 7 may be conveniently assembled and connected between the adjacent lower strip-shaped mounting frames 6 by sliding each of the engagement blocks 14 into the engagement groove 13 in sequence from the entrance of one side or both sides of the engagement groove 13.

In some embodiments, the engagement groove 13 is formed on each upper elastic module 5 and each lower elastic module 7, and the engagement block 14 is formed on each upper strip-shaped mounting frame 4 and each lower strip-shaped mounting frame 6. Alternatively, in other embodiments, with reference to FIG. 2 and FIG. 3, both sides of the upper strip-shaped mounting frame 4 are respectively formed with the engagement groove 13 extending in the longitudinal direction of the strip-shaped mounting frame, both sides of each upper elastic module 5 are formed with the engagement block 14, and the plurality of upper elastic modules 5 may be connected between adjacent upper strip-shaped mounting frames 4 by successively sliding their respective own engagement blocks 14 into the engagement grooves 13 from an entrance of the engagement grooves 13; both sides of the lower strip-shaped mounting frame 6 are respectively formed with the engagement groove 13 extending in the longitudinal direction of the strip-shaped mounting frame, both sides of each lower elastic module 7 are formed with the engagement block 14, and the plurality of lower elastic modules 7 may be connected between adjacent lower strip-shaped mounting frames 6 by successively sliding their respective own engagement blocks 14 into the engagement grooves 13 from the entrance of the engagement grooves 13. In addition, the engagement groove 13 formed on the strip-shaped mounting frames has an advantage that the above-mentioned connecting member can be connected to an upper side groove wall of the engagement groove of the lower strip-shaped mounting frame 6 below after extending from a lower side groove wall of the engagement groove of the upper strip-shaped mounting frame 4 and passing through the middle support layer 3, in this way the connecting member may be prevented from entering the engagement groove and affecting the slide of the engagement block.

Furthermore, with reference to FIG. 2 and FIG. 3, the elastic module assembly comprises an upper balancing pad 15 having a plurality of positioning holes and a lower balancing pad 16 having a plurality of positioning holes, wherein the upper balancing pad 15 is laid on the plurality of upper elastic modules 5 such that a portion of each of upper elastic modules 5 are received into a respective corresponding positioning hole of the upper balancing pad to restrict the movement of each of upper elastic modules 5 in the transverse direction of the upper balancing pad 15; the lower balancing pad 16 is laid under the plurality of lower elastic modules 7 such that a portion of each of lower elastic modules 7 are received into a respective corresponding positioning hole of the lower balancing pad to restrict the movement of each of lower elastic modules 7 in a transverse direction of the lower balancing pad 16. In this way, the integrity of the elastic module assembly may be effectively improved to enhance comfort by the balancing pads restricting the movement of the elastic modules in the transverse direction.

In addition, in the elastic module assembly, the peripheral edge of the middle support layer 3 comprises a part of a detachable structure, such as a toothed belt of a zipper structure or a face belt of a hook and loop fastener. The part of the detachable structure is configured to be connected with the other part of the detachable structure provided on a side enclosure covering portion of the outer covering, so that the peripheral edge of the middle support layer 3 is configured to be connected with the side enclosure covering portion via the detachable structure. In this way, when the elastic pad is assembled, the part of the detachable structure on the peripheral edge of the middle support layer 3 may be connected to the other part of the detachable structure on the side enclosure covering portion 19 of the outer covering 17 of the elastic pad, so as to realize the connection between the side enclosure covering portion 19 and the middle support layer 3. In this way, the side enclosure covering portion 19 may limit the elastic module assembly transversely, avoiding the displacement between the elastic module assembly and the outer covering 17. In addition, when the height of the elastic module assembly is high, the side enclosure covering portion 19 may be prevented from becoming bulky, thereby improving the aesthetic appearance of the elastic pad.

In addition, the detachable structure may be of various types, but it needs to be appreciated that the detachable structure may be of any type so long as the detachable connection between the side enclosure covering portion and the middle support layer 3 can be achieved. Thus, the elastic module assembly of the present disclosure does not limit the detachable structure to one or more types. That is, the detachable structure includes, but is not limited to, several types described below. For example, in one type of the detachable structure, the detachable structure comprises a zipper structure, wherein a part of the detachable structure is a toothed belt of the zipper structure, and the other toothed belt of the zipper structure and a zipper may be provided on the side enclosure covering portion, so that the side enclosure covering portion and the middle support layer 3 may be conveniently connected via the zipper structure. Certainly, the replacement of the side enclosure covering portion is also facilitated via the zipper structure. For example, in another type of the detachable structure, the detachable structure is hook&loop, whose one face band may be provided on the side enclosure covering portion, and the other face band may be provided on the middle support layer 3. In this way, the side enclosure covering portion may be easily mounted and detached by pulling and adhering the hook&loop. For another example, in other types of detachable structures, the detachable structure may be a snap button connection or a button connection, so that the snap button connection and the button connection may also conveniently achieve the connection between the side enclosure covering portion and the middle support layer 3.

In addition, the present disclosure provides an elastic pad 2 comprising an outer covering 17, an elastic pad layer 18, and the elastic module assembly 1 described above, wherein the elastic pad layer 18 and the elastic module assembly 1 are superimposed in an up-down direction and covered by the outer covering 17. In this way, the comfort of the elastic pad can be at least effectively improved as described above.

Furthermore, the elastic pad of the present disclosure may be used as a mattress, a sofa cushion or a chair pad.

Finally, the present disclosure provides a furniture comprising the elastic pad 2 as described above. Thus, as described above, the comfort of the furniture is significantly improved by the elastic pad, thereby improving the overall quality.

In addition, the furniture includes, but is not limited to, beds, sofas, chairs, sofas beds, soft-packaged benches, and the like.

The scope of protection of the present disclosure is defined only by the appended claims. Given the teaching of the present disclosure, those skilled in the art could easily envision using alternative structures of those disclosed herein as feasible alternative embodiments, and combining the embodiments disclosed herein to form new embodiments, which should all fall into the scope defined by the appended claims.

I claim:

1. An elastic module assembly used to form an elastic pad, comprising:

a middle support layer having an upper surface and a lower surface, wherein a peripheral edge of the middle support layer comprises a first part of a detachable structure configured to connect to a second part of the detachable structure provided on a side portion of an outer cover, so that the peripheral edge of the middle support layer is configured to be connected with the side portion via the detachable structure;

a plurality of upper strip-shaped mounting frames spaced apart on the upper surface;

a plurality of upper elastic modules secured between adjacent upper strip-shaped mounting frames;

a plurality of lower strip-shaped mounting frames spaced apart on the lower surface; and a plurality of lower elastic modules secured between adjacent lower strip-shaped mounting frames.

2. The elastic module assembly of claim 1 wherein each upper strip-shaped mounting frame is aligned over a corresponding lower strip-shaped mounting frame, and each upper elastic module is aligned over a corresponding lower elastic module.

3. The elastic module assembly of claim 2 further including a connecting member passing through and connecting each upper strip-shaped mounting frame and each lower strip-shaped mounting frame, and the middle support layer.

4. The elastic module assembly of claim 1 wherein the plurality of upper elastic modules and the plurality of lower elastic modules are detachable from the middle support layer, and the middle support layer can be wound up for storage.

5. The elastic module assembly of claim 1 wherein the upper elastic modules and the lower elastic modules have a truncated cone shape a smaller end above a larger end, the larger end of each upper elastic module connected to the upper strip-shaped mounting frames; and the larger end of each lower elastic module connected to the lower strip-shaped mounting frames.

6. The elastic module assembly of claim 1 wherein each of the upper elastic modules and the lower elastic modules has a frustum-shaped cavity, so that the upper elastic modules and the lower elastic modules can be stacked.

7. The elastic module assembly of claim 1 wherein each of the upper elastic modules and the lower elastic modules comprises a spring support and a conical spring arranged in the spring support; the spring support including a base, a top cover and flexible strips connected between the base and the top cover; a larger-diameter end of the conical spring connected to the base, a smaller-diameter end of the conical spring connected to the top cover, an outer surface of the conical spring in contact with the flexible strips, and the conical spring in a pre-compressed state in the spring support.

8. The elastic module assembly of claim 1 wherein the plurality of upper elastic modules can be sequentially slid and snapped between adjacent upper strip-shaped mounting frames by an upper slide-and-snapping structure including an engagement groove and an engagement block, and the plurality of lower elastic modules can be sequentially slid and snapped between adjacent lower strip-shaped mounting frames by a lower slide-and-snapping structure including an engagement groove and an engagement block.

9. The elastic module assembly of claim 8 wherein first and second sides of the upper strip-shaped mounting frame includes an upper engagement groove, both sides of each upper elastic module including an upper engagement block, so that the plurality of upper elastic modules can be connected between adjacent upper strip-shaped mounting frames by successively sliding the upper engagement blocks into the upper engagement grooves from an entrance of the upper engagement grooves;

first and second sides of the lower strip-shaped mounting frame are respectively formed with a lower engagement groove extending in a longitudinal direction of the strip-shaped mounting frame, both sides of each lower elastic module formed with a lower engagement block, so that the plurality of lower elastic modules can be connected between adjacent lower strip-shaped mounting frames by successively sliding the lower engagement blocks into the lower engagement grooves from an entrance of the lower engagement grooves.

10. The elastic module assembly of claim 1 further comprising an upper balancing pad having a plurality of upper positioning holes and a lower balancing pad having a plurality of lower positioning holes, wherein:

the upper balancing pad is laid on the plurality of upper elastic modules and a portion of each upper elastic module is received into one of the upper positioning holes to restrict movement of each upper elastic module; and the lower balancing pad is laid under the plurality of lower elastic modules and a portion of each lower elastic module is received into one of the lower positioning holes to restrict movement of each lower elastic module.

11. The elastic module assembly of claim 1 wherein the detachable structure comprises a zipper.

12. An elastic pad comprising an outer covering, an elastic pad layer, and the elastic module assembly of claim 1 wherein the elastic pad layer and the elastic module assembly are superimposed in an up-down direction and covered by the outer covering.

13. The elastic pad of claim 1 wherein the elastic pad is a mattress.

14. The elastic module assembly of claim 1 wherein the middle support layer comprises a canvas or fabric layer.

15. The elastic module assembly of claim 4 wherein the middle support layer can be wound up together with the upper strip-shaped mounting frame and the lower strip-shaped mounting frame, for storage.

16. An article of furniture, comprising:

an elastic module assembly including:

a middle support layer having an upper surface and a lower surface, wherein a peripheral edge of the middle support layer comprises a first part of a detachable structure;

a plurality of upper strip-shaped mounting frames spaced apart on the upper surface;

a plurality of upper elastic modules secured between adjacent upper strip- shaped mounting frames;

a plurality of lower strip-shaped mounting frames spaced apart on the lower surface; and a plurality of lower elastic modules secured between adjacent lower strip- shaped mounting frames;

an elastic pad layer on the elastic module assembly; and an outer covering enclosing the elastic module assembly and the elastic pad layer, wherein a side portion of the outer cover comprises a second part of the detachable structure, the second part is connected to the first part so that the peripheral edge of the middle support layer is connected with the side portion via the detachable structure.

* * * * *